United States Patent [19]

Kretschmar et al.

[11] Patent Number: 5,064,523

[45] **Date of Patent: * Nov. 12, 1991**

[54] PROCESS FOR THE HYDROGENATIVE CONVERSION OF HEAVY OILS AND RESIDUAL OILS, USED OILS AND WASTE OILS, MIXED WITH SEWAGE SLUDGE

[75] Inventors: Klaus Kretschmar, Dorsten; Ludwig Merz, Recklinghausen; Klaus Niemann, Oberhausen, all of Fed. Rep. of Germany

[73] Assignee: Veba Oel Technologie GmbH, Gelsenkirchen, Fed. Rep. of Germany

[ * ] Notice: The portion of the term of this patent subsequent to Jul. 17, 2007 has been disclaimed.

[21] Appl. No.: 267,289

[22] Filed: Nov. 4, 1988

[30] Foreign Application Priority Data

Nov. 4, 1987 [DE] Fed. Rep. of Germany ..... 3737370

[51] Int. Cl.[5] ..... C10G 49/02

[52] U.S. Cl. ..... 208/112; 208/144; 208/180; 208/400; 208/434; 585/240; 585/241

[58] Field of Search ..... 208/13, 142, 186, 179, 208/292, 283, 180, 112, 144, 262.5, 400, 434; 44/50, 61; 585/240.21; 48/197 H, 197 FM

[56] References Cited

U.S. PATENT DOCUMENTS

| | | | |
|---|---|---|---|
| Re. 29,156 | 3/1977 | Marsh | 44/503 |
| 2,231,597 | 2/1941 | Shibata | 44/61 |
| 4,206,032 | 6/1980 | Friedman et al. | 208/408 |
| 4,370,221 | 1/1983 | Patmore et al. | 208/112 |
| 4,396,786 | 8/1983 | Bond et al. | 585/240 |
| 4,417,976 | 11/1983 | Sander et al. | 208/13 |
| 4,618,735 | 10/1986 | Bridle et al. | 208/13 |
| 4,652,686 | 3/1987 | Coenan et al. | 48/197 A |

*Primary Examiner*—Helane E. Myers

*Attorney, Agent, or Firm*—Oblon, Spivak, McClelland, Maier & Neustadt

[57] ABSTRACT

Process for the hydrogenative conversion of heavy oils and residual oils, used oils and waste oils, mixed with sewage sludge in a typical liquid phase hydrogenator with gases containing hydrogen, with the addition of a finely ground substance that preferably has a large internal surface area, as additive. The additive is added in two different particle size ranges so that a portion of the additive is present as a fine particle size fraction iwth a particle size of 90 μm or less and another portion as a coarse particle size fraction with a particle size of 100 μm to 2000 μm, preferably 100 to 1000 μm with the procedure being carried out with a weight ratio of raw oils to sewage sludge used of 10:1 to 1:1.5. Conversion of vacuum residue of a Venezuelan heavy oil with the addition of 2 wt. % of lignite coke as additive and with the admixture of 10 wt. % industrial or municipal sewage sludge in a liquid phase hydrogenator to obtain useful liquid products in particular, and extensive conversion of the organic fractions of the sewage sludge.

15 Claims, No Drawings

PROCESS FOR THE HYDROGENATIVE CONVERSION OF HEAVY OILS AND RESIDUAL OILS, USED OILS AND WASTE OILS, MIXED WITH SEWAGE SLUDGE

BACKGROUND OF THE INVENTION

1. Field of the Invention

This invention concerns a process for the hydrogenative conversion of heavy oils and residual oils, used oils and waste oils, mixed with sewage sludge.

More particularly, the invention relates to a process for the hydrogenative conversion of heavy oils and residual oils, used oils and waste oils, mixed with sewage sludge in a typical liquid phase hydrogenator with gases containing hydrogen, with the addition of a finely ground substance that preferably has a large internal surface area, as additive.

2. Discussion of the Background

The disposal of industrial and municipal sewage sludge presents a serious problem and at the same time a challenge to society. Industrial and municipal sewage sludges frequently contain constituents which create environmental problems and thereby preclude the direct application of the sludge to agricultural land, its disposal in landfills, by combustion or by pyrolysis processes (*Kranich et al*, Hydroliquefaction of Sewage Sludge, National Conference or Municipal and Industrial Sludge Utilization and Disposal, 1980, pp. 137–140).

One method of treating organic waste products is to hydrogenate the waste products in the presence of raw oils such as heavy oil, residual oil, used oil and waste oil, for example, as taught in U.S. application Ser. No. 07/172,225. In these processes, the raw oil and waste products are mixed with hydrogen gas and heated in one or more hydrogenation reactors. The hydrogenation may be accomplished in either the liquid or solid phase and may be facilitated by the incorporation of various additives into the hydrogenation mixture.

Depending on the desired extent of conversion and tendency toward coke formation of the raw material, a disposable additive, activated coke from anthracite or lignite, carbon black, red mud, ferric oxide, furnace dust, and the like, may be used as an additive. Hydrogenation of the raw oil in the presence of organic waste products converts quantities of the waste products into commercially important gaseous reaction products as well as valuable liquid hydrocarbon products.

A need continues to exist for improved processes for the hydrogenation of raw oils and waste products, particularly sewage sludge.

SUMMARY OF THE INVENTION

Accordingly, one object of the present invention is to provide an improved process for the hydrogenation of raw oils mixed with sewage sludge.

This and other objects which will become apparent from the following specification have been achieved by the present process for the hydrogenative conversion of a mixture of raw oils and sewage sludge, which comprises the step of:

hydrogenating the mixture in the liquid phase or combined liquid and gas phases with a hydrogen-containing gas, the gas having a hydrogen partial pressure of 50–300 bar, at a temperature of 250°–500° C., with a gas/oil ratio of 100–10,000 $m^3/t$, wherein the hydrogenation is conducted in the presence of 0.5–5 wt. % based on the total amount of the mixture, of at least one additive, wherein the additive comprises (1) particles having two different particle size fractions, a fine particle size fraction having a particle size of 90 microns or less, and a coarse particle size fraction having a particle size of 100–2,000 microns or (2) a continuous particle size distribution having a coarse particle size fraction having a particle size of 100–2,000 microns, wherein the hydrogenation is carried out at a weight ratio of raw oil to sewage sludge of 10:1 to 1:1.5.

DETAILED DESCRIPTION OF THE PREFERRED EMBODIMENTS

The present process for the hydrogenative conversion of raw oils such as heavy oils, residual oils, used oils and waste oils, mixed with municipal and industrial sewage sludge in liquid or combined liquid and gas phases is carried out using a high pressure pump for transporting the oil or the oil/solid mixture including an additive into the high-pressure section of a hydrogenation system. Circulating gas and fresh hydrogen are heated and admixed with the residual oil, for example, in the high-pressure section. To utilize the heat of reaction of the reaction products, the reaction mixture flows through a regenerator battery and a peak heater and then arrives in the liquid phase reactors. The reactor system consists, for example, of three vertical empty tube reactors connected in series, which are operated with a direction of flow from bottom to top. The conversion occurs in the reactors at temperatures between about 250–500° C., preferably 400° and 490° C. and with a hydrogen partial pressure of 50 to 300 bar. A quasi-isothermal operation of the reactors is possible by injecting cold gas.

The unconverted fraction of the supplied heavy oils and residual oils and of the solids is separated from the gaseous reaction products under process conditions in one or more hot separators which follow the reactors and which are operated at approximately the same temperature as the reactors. The bottom product from the hot separators is depressurized in a multistage flash unit. In one embodiment, the reactors are operated as a combined operation in the liquid and gas phases, and the head product from the hot separators, the flash distillates, and any crude oil distillate fractions to be coprocessed are combined and fed to one or more following gas phase reactors. Hydrotreating or mild hydrocracking occurs on a fixed catalytic bed under the same total pressure as in the liquid phase under trickle-flow conditions.

After intensive cooling and condensation, the gas and liquid are separated in a high-pressure cold separator. The liquid product is depressurized and can be processed further in conventional refining processes. The gaseous reaction products, including $C_1$ to $C_4$ gases, $H_2S$, and $NH_3$, are largely separated from the process gas using known technology, and the remaining hydrogen is recycled as circulating gas. Suitable process conditions and apparatus are further described in copending U.S. application Ser. No. 07/172,225 incorporated herein by reference.

Typical properties of residual oils and heavy oil distillation residues used as the raw oil for the present process contain from 80–100 wt. % of a residual fraction (500° C.+) from heavy oil distillation residues with a density of 10° API or lower, and a fraction of asphalts between 8 and 25 wt. %. High metal contents up to 2200 ppm may be present, as well as sulfur contents up to 7 wt. % and nitrogen up to 1 wt. %.

Sewage sludges may contain problem constituents, depending on their origin and composition, which preclude disposal by the established procedures known in the art or by combustion or pyrolysis processes. The treatment process must be adequate to decompose problem constituents, with the additional necessity of observing environmental protection aspects in particular.

Essential to the invention is the addition of 0.5–5 wt. % of a disposable additive. The additive may have two different particle size ranges so that a portion of the additive is present as a fine particle size fraction with a particle size of 90 μm or less and another portion is present as a coarse particle size fraction with an average particle size of 100 μm to 2000 μm, preferably 100 μm to 1000 μm. Alternatively, a continuous particle size distribution having a coarse particle size fraction having a particle size range of 100–2,000 microns may be used. The present procedure should be carried out with a weight ratio of raw oils to sewage sludge used of 10:1 to 1:1.5.

The sewage sludge used is generally dried to a water content less than 10%, preferably less than 2%, and if necessary, coarse foreign objects are removed by grinding, sifting, and/or classification processes, and the sludge is brought to a particle size of less than 2 mm, preferably less than 1 mm. The sewage sludge used can entirely or partly replace the added disposable additive as noted below. The proportion of the coarse particle size fraction is preferably 20 wt. % or more of the additive used.

Since the coarse fraction is preferentially concentrated in the liquid phase reactor system, it is possible in many cases to reduce the higher proportion of coarse particle size fraction in the startup phase from 20 wt. % or more, to 5 wt. % or more during the operating phase, and optionally even to add the additive without further addition of the coarse particle size fraction.

The additive, both the fine particle size fraction and the coarse particle size fraction, may be selected from high surface area solids such as anthracite and lignite cokes from blast furnaces and hearth furnaces, carbon blacks from the gasification of heavy oil, anthracite, hydrogenation residues, or lignite, as well as the activated cokes produced from them. Also, petroleum coke, furnace dust, and dusts from Winkler gasification of coal may be used. Additional additives include red mud, iron oxides, electrostatic filter dusts, and cyclone dusts from the processing of metals and ores. Preferred additives are activated cokes made from anthracite or lignite, soot, red mud, iron oxides and furnace dusts from the gasification of coal. Mixtures of additives may be used.

In general, the same additive is used as the fine particle size fraction and the coarse particle size fraction. However, it is possible and in many cases beneficial to use additives of different composition for the fine and coarse particle size fractions, for example, $Fe_2O_3$ as the fine particle size fraction with an upper particle size limit of 30 μm, and lignite activated coke with a lower particle size limit of 120 μm.

The known impregnation of catalyst supports with one or more salts of metals from Groups 1*b*-7*b*, 8 and 4*a* of the Periodic Table of the Elements, such as molybdenum, cobalt, tungsten, vanadium, nickel, and especially iron, and the known neutralization of these salts or of their aqueous solutions with sodium hydroxide solution can also be carried over to this process from other known processes. One or both of the two fractions of the additive may be impregnated with the mentioned metal salt solutions. Preferred metal salts are the iron, cobalt, nickel, vanadium, molybdenum salts and mixtures thereof.

The additive can be used in a continuous particle size distribution with the corresponding coarse particle size fraction of 100 μm or larger. It is preferred to use two fractions sharply separated in particle size spectrum.

In the hydrogenation of mixtures of raw oils such as heavy oils or residual oils, used oils or waste oils with sewage sludge, with the weight ratio of oil to sewage sludge preferably being between 10:1 and 1:1.5, a sewage sludge can be used that contains a corresponding proportion of coarse particle size fraction of 100 μm or larger. The sewage sludge can therefore partly replace the additive having this particle size.

Conversion of the vacuum residue of a Venezuelan heavy oil with the addition of about 2 wt. % lignite coke as the additive and with the admixture of 10 wt. % sewage sludge in a liquid phase hydrogenator to obtain particularly useful liquid products is a preferred embodiment and extensive conversion of the organic fractions of the sewage sludge is observed.

Other features of the invention will become apparent in the course of the following description of an examplary embodiment which is given for illustration of the invention and is not intended to be limiting thereof.

EXAMPLE

In a hydrogenation system operated continuously with three successive vertical liquid phase hydrogenation reactors (LPH) without internal structure, the vacuum residue of a Venezuelan heavy oil was reacted with 1.5 $m^3$ of $H_2$ per kg of residue with a hydrogen partial pressure of 190 bar, with the addition of 2 wt. % of lignite coke having 90 wt. % of a fine particle size fraction (less than 90 μm) and 10 wt. % of a coarse particle size fraction (greater than 90 μm), and with the admixture of 10 wt. % sewage sludge (dried to less than 2% residual moisture, ground, and screened to less than 80 μm). To produce a residue conversion rate (conversion) of 90%, an average temperature of 465° C. was set over the successive liquid phase reactors. The specific throughput was 0.5 kg/l×h (500° C.+).

The results are summarized in the table below.

TABLE

| | |
|---|---|
| Operating conditions | |
| Temperature LPH | 465° C. |
| Specific throughput | 0.54 t/$m^3$h of oil >500° C. |
| Additive feedstock | 2 wt. % based on oil feedstock |
| Sewage sludge feedstock | 10 wt. % based on oil feedstock |
| Yield | |
| Conversion 500° C.+ oil | 90.2% |
| $C_1$–$C_4$ gases | 7.6% of feedstock |
| Sewage sludge conversion (organic fraction) | >70% |

The hydrogenative disposal of sewage sludge by the process of the present invention converts the organic constituents of the sludge in high yield to valuable liquid and gaseous hydrocarbons, which can be treated further in conventional refinery equipment and used again, together with the heavy/residual conversion products.

Obviously, numerous modifications and variations of the present invention are possible in light of the above teachings. It is therefore to be understood that within the scope of the appended claims, the invention may be practiced otherwise than as specifically described herein.

What is new and desired to be secured by Letters Patent of the United States is:

1. A process for the hydrogenative conversion of a mixture of a raw oil and sewage sludge to liquid and gasous hydrocarbon products, comprising the step of:

hydrogenating said mixture in the liquid phase or combined liquid and gas phases with a hydrogen-containing gas, said gas having a hydrogen partial pressure of 50–300 bar, at a temperature of 250°–500° C., with a gas/oil ratio of 100–10,000 $m^3/t$, wherein said hydrogenation is conducted in the presence of at least one additive selected from the group consisting of anthracite cokes, lignite cokes, carbon blacks, activated cokes, petroleum cokes, furnace dust, dusts from Winkler gasification of coal, red mud, iron oxides, electrostatic filter dusts and cyclone dusts, said additive being present in an amount from 0.5–5 wt. % based on the total amount of said mixture, and said additive comprising (1) two different particle size fractions, a fine particle size fraction having a particle size of 90 microns or less and a coarse particle size fraction having a particle size of 100–2,000 microns, or (2) a continuous particle size distribution having a particle size of 100–2,000 microns, wherein the hydrogenation is carried out with a weight ratio of raw oil to sewage sludge in the range of 10:1 to 1:1.5.

2. The process of claim 1, wherein said hydrogenation is conducted at 150–200 bar.

3. The process of claim 1, wherein said temperature is in the range 400°–490° C.

4. The process of claim 1, wherein said gas-oil ratio is in the range of 1,000–5,000 $m^3/t$.

5. The process of claim 1, wherein said additive comprises two particle size fractions, a fine particle size fraction having a particle size of 90 microns or less and a coarse particle size fraction having a particle size of 100–2,000 microns.

6. The process of claim 5, wherein said coarse particle size fraction has a particle size of 100–1,000 microns.

7. The process of claim 5, wherein said coarse particle size fraction comprises 20 wt. % or more of said additive.

8. The process of claim 1, wherein said additive is selected from the group consisting of activated coke from anthracite or lignite, carbon black, red mud, soot, ferric oxide, furnace dust and mixtures thereof.

9. The process of claim 1, wherein said additive is used in a continuous particle size distribution having a particle size of 100–2,000 microns.

10. The process of claim 9, wherein said continuous particle size distribution has a particle size in the range from 100–1,000 microns.

11. The process of claim 1, wherein said additive is impregnated with at least one metal salt, wherein the metal is selected from the metals in Groups 1*b*-7*b*, 8 and 4*a* of the Periodic Table of the Elements.

12. The process of claim 11, wherein said metal is selected from the group consisting of iron, cobalt, nickel, vanadium and molybdenum.

13. The process of claim 12, wherein said metal is iron.

14. The process of claim 1, wherein said additive is lignite coke.

15. The process of claim 1, wherein a portion of said sewage sludge has a particle size in the range from 100–2,000 microns and said sewage sludge at least partially replaces said additive.

* * * * *